US010240272B2

(12) United States Patent
Farrington et al.

(10) Patent No.: US 10,240,272 B2
(45) Date of Patent: Mar. 26, 2019

(54) LAUNDRY TREATING APPLIANCE WITH DRIVE ATTACHMENT MECHANISM

(71) Applicant: WHIRLPOOL CORPORATION, Benton Harbor, MI (US)

(72) Inventors: Eric K. Farrington, Stevensville, MI (US); Steven Fricke, Saint Joseph, MI (US); Nicholas C. Fugal, Benton Harbor, MI (US); Christine L. Strain, Stevensville, MI (US); Philip R. Thompson, Alvada, OH (US); Robert C. Williams, Benton Harbor, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 239 days.

(21) Appl. No.: 15/154,172

(22) Filed: May 13, 2016

(65) Prior Publication Data

US 2017/0327989 A1 Nov. 16, 2017

(51) Int. Cl.

| | |
|---|---|
| ***D06F 37/20*** | (2006.01) |
| ***D06F 37/30*** | (2006.01) |
| ***D06F 37/40*** | (2006.01) |
| ***D06F 37/24*** | (2006.01) |
| *D06F 33/02* | (2006.01) |

(52) U.S. Cl.

CPC ..... *D06F 37/206* (2013.01); *D06F 37/20* (2013.01); *D06F 37/24* (2013.01); *D06F 37/30* (2013.01); *D06F 37/40* (2013.01); *D06F 33/02* (2013.01); *D06F 37/245* (2013.01); *D06F 2204/065* (2013.01)

(58) Field of Classification Search

CPC ..... D06F 37/02; D06F 37/20; D06F 37/24; D06F 37/30; D06F 37/206; D06F 37/40

See application file for complete search history.

(56) References Cited

U.S. PATENT DOCUMENTS

| | | | | |
|---|---|---|---|---|
| 3,603,118 | A * | 9/1971 | Brucken | D06F 23/04 68/174 |
| 3,604,029 | A * | 9/1971 | Bain | D06F 37/30 184/6.18 |
| 4,000,631 | A * | 1/1977 | Drews | D06F 23/04 403/371 |
| 2013/0014547 | A1 * | 1/2013 | Kim | D06F 23/04 68/23 R |

(Continued)

FOREIGN PATENT DOCUMENTS

| | | | |
|---|---|---|---|
| JP | 2014061049 | A | 4/2014 |
| WO | 2013094112 | A1 | 6/2013 |

*Primary Examiner* — Joseph L. Perrin
(74) *Attorney, Agent, or Firm* — McGarry Bair PC

(57) ABSTRACT

A laundry treating appliance having a tub defining an interior, a basket located within the interior and rotatably mounted within the tub and having an upper and lower basket base portion, a balance ring mounted to the upper edge of the basket peripheral wall, a clothes mover rotatably mounted within the basket, a drive system comprising a motor operably coupled to the basket and the clothes mover and configured to selectively oscillate or rotate the basket or the clothes mover and a first and second drive shaft, and a drive attachment mechanism configured to couple the basket to the second drive shaft, with the drive attachment mechanism comprising a bushing assembly.

19 Claims, 6 Drawing Sheets

(56) References Cited

U.S. PATENT DOCUMENTS

| | | | | |
|---|---|---|---|---|
| 2013/0160217 | A1* | 6/2013 | Tietz | D06F 39/10 8/137 |
| 2014/0076006 | A1* | 3/2014 | Lee | D06F 37/30 68/140 |
| 2015/0033802 | A1* | 2/2015 | Kleinmanns | D06F 37/40 68/133 |
| 2017/0096766 | A1* | 4/2017 | Yu | D06F 37/269 |

* cited by examiner

LAUNDRY TREATING APPLIANCE WITH DRIVE ATTACHMENT MECHANISM

BACKGROUND OF THE INVENTION

Laundry treating appliances, such as washing machines, refreshers, and non-aqueous systems, can have a configuration based on a rotating container that at least partially defines a treating chamber in which laundry items are placed for treating. The laundry treating appliance may have a controller that implements a number of user-selectable, pre-programmed cycles of operation. Hot water, cold water, or a mixture thereof along with various treating chemistries may be supplied to the treating chamber in accordance with the cycle of operation.

Washing machines having a drive system between the motor and clothes mover and basket require an attachment mechanism so that the washing machine will be able to operate in both an agitate mode and an extraction mode to drive the oscillation of the basket and/or the clothes mover. The drive system can have several configurations such as direct or belt drive. The attachment mechanism for attaching the drive to the basket and the clothes mover must be robust enough to withstand the overturning forces placed on the drive area. Conventional washing machines can incorporate a basket base structure formed from metal, adding significant weight to the basket assembly.

BRIEF SUMMARY OF THE INVENTION

In one aspect, illustrative embodiments in accordance with the present disclosure relate to a laundry treating appliance including a tub defining a tub interior and a basket rotatably mounted within the tub interior. The basket has a basket base comprising an upper base portion and a separate lower base portion mounted to the upper base portion, as well as a basket peripheral wall extending from the basket base, with the basket base and the basket peripheral wall defining a basket interior that forms at least part of a laundry treating chamber. The basket peripheral wall terminates at an upper edge. The laundry treating appliance further includes a balance ring mounted to the upper edge of the basket peripheral wall, a clothes mover rotatably mounted within the basket interior, and a drive system. The drive system includes a motor operably coupled to the basket and the clothes mover that is configured to selectively oscillate or rotate the basket or the clothes mover. The drive system further includes a first drive shaft operably coupled to the motor and the clothes mover to oscillate or rotate the clothes mover, a second drive shaft operably coupled to the motor and the basket to oscillate or rotate the basket, and a drive attachment mechanism. The drive attachment mechanism is configured to couple the basket to the second drive shaft and includes a bushing assembly having an upper bushing insert molded into the upper base portion and a lower bushing insert molded into the lower base portion, and a lock nut operably coupled to an upper end of the bushing assembly and threadably mounted to the second drive shaft.

In another aspect, illustrative embodiments in accordance with the present disclosure relate to a laundry treating appliance including a tub defining a tub interior and a basket rotatably mounted within the tub interior. The basket has a basket base comprising an upper base portion and a separate lower base portion mounted to the upper base portion, as well as a basket peripheral wall extending from the basket base, with the basket base and the basket peripheral wall defining a basket interior that forms at least part of a laundry treating chamber. The basket peripheral wall terminates at an upper edge. The laundry treating appliance further includes a motor operably coupled to the basket via a drive shaft and a drive attachment assembly, where the motor is configured to selectively oscillate or rotate the basket within the tub. The drive attachment mechanism is configured to couple the basket to the drive shaft and includes a bushing assembly having an upper bushing molded into the upper base portion and a lower bushing molded into the lower base portion.

In yet another aspect, illustrative embodiments in accordance with the present disclosure relate to a method for installing a drive attachment mechanism in a laundry treating appliance that includes determining a center of a balance ring of a basket of the laundry treating appliance. The method further includes determining a center of an upper chamfered surface of an upper bushing located within an upper base portion of the basket. An upper chamfered surface of a lower bushing that has a flange is machined and molded into a lower base portion of the basket base so that its center is aligned along an axis extending through the center of the balance ring and the center of the upper chamfered surface. The upper base portion and the lower base portion are mounted together.

DETAILED DESCRIPTION OF EMBODIMENTS OF THE INVENTION

Vertical axis washing machines requiring a high revolutions per minute spin speed can have a particular need for a strong drive to basket attachment. Drive attachment mechanisms in accordance with the present disclosure enable a method of robust attachment of the drive to the basket and clothes mover that can accommodate the overturning forces placed thereon while allowing for lighter weight basket bases and also reducing total indicated runout. In one aspect, this is achieved by providing a drive attachment mechanism comprising a two-piece basket base, a bushing assembly having an upper and lower bushing insert, and a lock nut to operably couple the upper end of the bushing assembly with the drive shaft of the washing machine.

Figure 1:
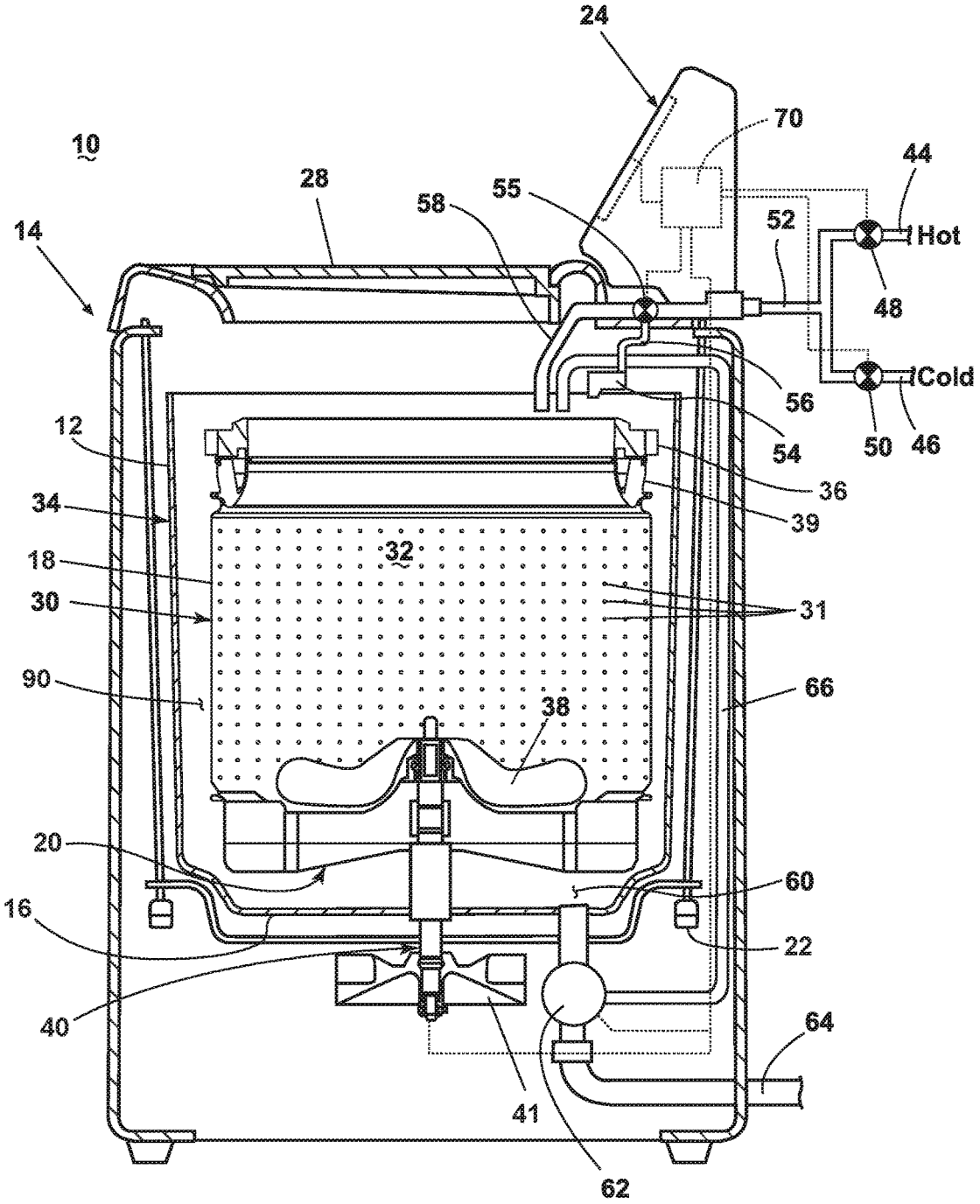
FIG. 1 illustrates a schematic cross-sectional view of a laundry treating appliance in the form of a washing machine according to one embodiment of the invention.

FIG. 1 is a schematic sectional view of a laundry treating appliance shown in the form of a washing machine 10 according to one embodiment of the invention. While the laundry treating appliance is illustrated as a vertical axis, top-fill washing machine, the embodiments of the invention can have applicability in other fabric treating appliances, non-limiting examples of which include a combination washing machine and dryer, a refreshing/revitalizing machine, an extractor, or a non-aqueous washing apparatus.

Washing machines are typically categorized as either a vertical axis washing machine or a horizontal axis washing machine. As used herein, the "vertical axis" washing machine refers to a washing machine having a rotatable drum, perforate or imperforate, that holds fabric items and a clothes mover, such as an agitator, impeller, nutator, and the like within the drum. The clothes mover moves within the drum to impart mechanical energy directly to the clothes or indirectly through wash liquid in the drum. The clothes mover may typically be moved in a reciprocating rotational movement. In some vertical axis washing machines, the drum rotates about a vertical axis generally perpendicular to a surface that supports the washing machine. However, the rotational axis need not be vertical. The drum may rotate about an axis inclined relative to the vertical axis. As used herein, the "horizontal axis" washing machine refers to a washing machine having a rotatable drum, perforated or imperforate, that holds fabric items and washes the fabric items by the fabric items rubbing against one another as the drum rotates. In some horizontal axis washing machines, the drum rotates about a horizontal axis generally parallel to a surface that supports the washing machine. However, the rotational axis need not be horizontal. The drum may rotate about an axis inclined relative to the horizontal axis. In horizontal axis washing machines, the clothes are lifted by the rotating drum and then fall in response to gravity to form a tumbling action. Mechanical energy is imparted to the clothes by the tumbling action formed by the repeated lifting and dropping of the clothes. Vertical axis and horizontal axis machines are best differentiated by the manner in which they impart mechanical energy to the fabric articles. The illustrated exemplary washing machine of FIG. 1 is a vertical axis washing machine.

As illustrated in FIG. 1, the washing machine 10 can include a structural support system comprising a cabinet 14 that defines a housing, within which a laundry holding system resides. The cabinet 14 can be a housing having a chassis and/or a frame, to which decorative panels may or may not be mounted, defining an interior that receives components typically found in a conventional washing machine, such as motors, pumps, fluid lines, controls, sensors, transducers, and the like. Such components will not be described further herein except as necessary for a complete understanding of the invention.

The fabric holding system of the illustrated exemplary washing machine 10 can include a rotatable basket 30 having an open top that can be disposed within the interior of the cabinet 14 and may define a treating chamber 32 for receiving laundry items for treatment. A tub 34 can also be positioned within the cabinet 14 and can define an interior 90 within which the basket 30 can be positioned. The tub 34 can have a generally cylindrical side or tub peripheral wall 12 closed at its bottom end by a base 16 that can at least partially define a sump 60.

The basket 30 can have a generally peripheral side wall 18, which is illustrated as a cylindrical side wall, closed at the basket end by a basket base 20 to at least partially define the treating chamber 32. The basket 30 can be rotatably mounted within the tub 34 for rotation about a vertical basket axis of rotation and can include a plurality of perforations 31, such that liquid may flow between the tub 34 and the rotatable basket 30 through the perforations 31. While the illustrated washing machine 10 includes both the tub 34 and the basket 30, with the basket 30 defining the treating chamber 32, it is within the scope of the invention for the laundry treating appliance to include only one receptacle, with the receptacle defining the laundry treatment chamber for receiving the load to be treated.

A balance ring 50 is disposed at the top of basket 30 to counterbalance a load imbalance that can occur within the treating chamber 32 during a cycle of operation. The illustrated balance ring 50 is provided at a terminal edge 39 of the basket 30. The top of the cabinet 14 can include a selectively openable lid 28 to provide access into the laundry treating chamber 32 through an open top of the basket 30.

A laundry mover 38 may be rotatably mounted within the basket 30 to impart mechanical agitation to a load of laundry placed in the basket 30. The laundry mover 38 can be oscillated or rotated about its vertical axis of rotation during a cycle of operation in order to produce load motion effective to wash the load contained within the treating chamber 32. Other exemplary types of laundry movers include, but are not limited to, an agitator, a wobble plate, and a hybrid impeller/agitator.

The basket 30 and the laundry mover 38 may be driven by a drive system 40 that includes a motor 41, which can include a gear case, operably coupled with the basket 30 and laundry mover 38. The motor 41 can rotate the basket 30 at various speeds in either rotational direction about the vertical axis of rotation, including at a spin speed wherein a centrifugal force at the inner surface of the basket side wall 18 is 1 g or greater. Spin speeds are commonly known for use in extracting liquid from the laundry items in the basket 30, such as after a wash or rinse step in a treating cycle of operation. A loss motion device or clutch (not shown) can be included in the drive system 40 and can selectively operably couple the motor 41 with either the basket 30 and/or the laundry mover 38.

A suspension system 22 can dynamically hold the tub 34 within the cabinet 14. The suspension system 22 can dissipate a determined degree of vibratory energy generated by the rotation of the basket 30 and/or the laundry mover 38 during a treating cycle of operation. Together, the tub 34, the basket 30, and any contents of the basket 30, such as liquid and laundry items, define a suspended mass for the suspension system 22.

A liquid supply system can be provided to liquid, such as water or a combination of water and one or more wash aids, such as detergent, into the treating chamber 32. The liquid supply system can include a water supply configured to supply hot or cold water. The water supply can include a hot water inlet 44 and a cold water inlet 46, a valve assembly, which can include a hot water valve 48, a cold water valve 50, and a diverter valve 55, and various conduits 52, 56, 58. The valves 48, 50 are selectively openable to provide water, such as from a household water supply (not shown) to the conduit 52. The valves 48, 50 can be opened individually or together to provide a mix of hot and cold water at a selected temperature. While the valves 48, 50 and conduit 52 are illustrated exteriorly of the cabinet 14, it may be understood that these components can be internal to the cabinet 14.

As illustrated, a detergent dispenser 54 can be fluidly coupled with the conduit 52 through a diverter valve 55 and a first water conduit 56. The detergent dispenser 54 can include means for supplying or mixing detergent to or with water from the first water conduit 56 and can supply such treating liquid to the tub 34. It has been contemplated that water from the first water conduit 56 can also be supplied to the tub 34 through the detergent dispenser 54 without the addition of a detergent. A second water conduit, illustrated as a separate water inlet 58, can also be fluidly coupled with the conduit 52 through the diverter valve 55 such that water can be supplied directly to the treating chamber through the open top of the basket 30. Additionally, the liquid supply system can differ from the configuration shown, such as by inclusion of other valves, conduits, wash aid dispensers, heaters, sensors, such as water level sensors and temperature sensors, and the like, to control the flow of treating liquid through the washing machine 10 and for the introduction of more than one type of detergent/wash aid.

A liquid recirculation system can be provided for recirculating liquid from the tub 34 into the treating chamber 32. More specifically, a sump 60 can be located in the bottom of the tub 34 and the liquid recirculation system can be configured to recirculate treating liquid from the sump 60 onto the top of a laundry load located in the treating chamber 32. A pump 62 can be housed below the tub 34 and can have an inlet fluidly coupled with the sump 60 and an outlet configured to fluidly couple to either or both a household drain 64 or a recirculation conduit 66. In this configuration, the pump 62 can be used to drain or recirculate wash water in the sump 60. As illustrated, the recirculation conduit 66 can be fluidly coupled with the treating chamber 32 such that it supplies liquid into the open top of the basket 30. The liquid recirculation system can include other types of recirculation systems.

The washing machine 10 can also be provided with a dispensing system for dispensing treating chemistry to the basket 26, either directly or mixed with water from the liquid supply system, for use in treating the laundry according to a cycle of operation. The dispensing system can include a dispenser 72, which can be a single use dispenser, a bulk dispenser, or a combination of a single use and bulk dispenser. The dispenser 72 fluidly couples to a dispenser outlet 73 where treating chemistry can be supplied to the basket 26. Water can be supplied to the dispenser 72 from the liquid supply conduit 60 by directing the valve assembly 62 to direct the flow of water to the dispenser 72 through a dispensing supply conduit 74. In this case, the valve assembly 62 can be a diverter valve having multiple outlets such that the diverter valve can selectively direct a flow of liquid to one or both of the liquid supply outlet 64 and the dispensing supply conduit 74 and into the treating chamber 42.

It is noted that the illustrated drive system, suspension system, liquid supply system, recirculation and drain system, and dispensing system are shown for exemplary purposes only and are not limited to the systems shown in the drawings and described above. For example, the liquid supply, dispensing, and recirculation and pump systems can differ from the configuration shown in FIG. 1, such as by inclusion of other valves, conduits, treating chemistry dispensers, sensors (such as liquid level sensors and temperature sensors), and the like, to control the flow of liquid through the washing machine 10 and for the introduction of more than one type of treating chemistry. For example, the liquid supply system and/or the dispensing system can be configured to supply liquid into the interior of the tub 34 not occupied by the basket 30 such that liquid can be supplied directly to the tub 34 without having to travel through the basket 30. In another example, the liquid supply system can include a single valve for controlling the flow of water from the household water source. In another example, the recirculation and pump system can include two separate pumps for recirculation and draining, instead of the single pump as previously described.

The washing machine 10 can also be provided with a heating system (not shown) to heat liquid provided to the treating chamber 32. In one example, the heating system can include a heating element provided in the sump to heat liquid that collects in the sump. Alternatively, the heating system can be in the form of an in-line heater that heats the liquid as it flows through the liquid supply, dispensing and/or recirculation systems.

The washing machine 10 can further include a controller 70 coupled with various working components of the washing machine 10 to control the operation of the working components and to implement one or more treating cycles of operation. The control system can further include a user interface 24 that is operably coupled with the controller 70. The user interface 24 can include one or more knobs, dials, switches, displays, touch screens and the like for communicating with the user, such as to receive input and provide output. The user can enter different types of information including, without limitation, cycle selection and cycle parameters, such as cycle options.

The controller 80 can include the machine controller and any additional controllers provided for controlling any of the components of the washing machine 10. For example, the controller 70 can include the machine controller and a motor controller. Many known types of controllers can be used for the controller 70. It is contemplated that the controller is a microprocessor-based controller that implements control software and sends/receives one or more electrical signals to/from each of the various working components to implement the control software. As an example, proportional control (P), proportional integral control (PI), and proportional derivative control (PD), or a combination thereof, a proportional integral derivative control (PID), can be used to control the various components of the washing machine 10.

Figure 2:
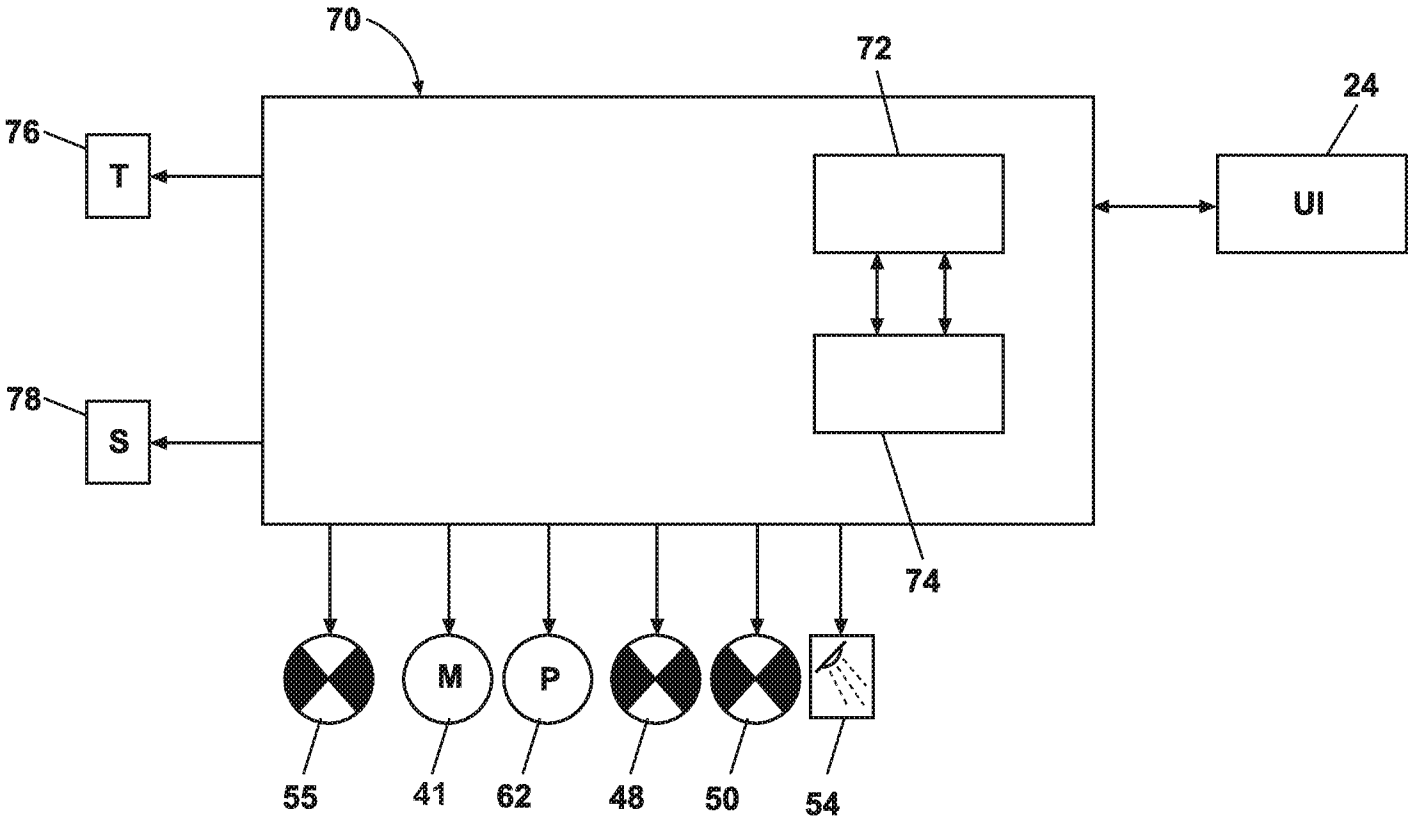
FIG. 2 illustrates a schematic representation of a controller for controlling the operation of one or more components of the laundry treating appliance of FIG. 1.

As illustrated in FIG. 2, the controller 70 can be provided with a memory 72 and a central processing unit (CPU) 74. The memory 72 can be used for storing the control software that can be executed by the CPU 74 in completing a cycle of operation using the washing machine 10 and any additional software. Examples, without limitation, of treating cycles of operation include: wash, heavy-duty wash, delicate wash, quick wash, pre-wash, refresh, rinse only, and timed wash, which can be selected at the user interface 24. The memory 72 can also be used to store information, such as a database or table, and to store data received from the one or more components of the washing machine 10 that can be communicably coupled with the controller 70. The database or table can be used to store the various operating parameters for the one or more cycles of operation, including factory default values for the operating parameters and any adjustments to them by the control system or by user input.

The controller 70 can be operably coupled with one or more components of the washing machine 10 for communicating with and/or controlling the operation of the components to complete a cycle of operation. For example, the controller 70 can be coupled with the hot water valve 48, the cold water valve 50, the diverter valve 55, and the detergent dispenser 54 for controlling the temperature and flow rate of treating liquid into the treating chamber 32; the pump 62 for controlling the amount of treating liquid in the treating chamber 32 or sump 60; drive system 40 including a motor 41 for controlling the direction and speed of rotation of the basket 30 and/or the clothes mover 38; and the user interface 24 for receiving user selected inputs and communicating information to the user. The controller 70 can also receive input from a temperature sensor 76, such as a thermistor, which can detect the temperature of the treating liquid in the treating chamber 32 and/or the temperature of the treating liquid being supplied to the treating chamber 32. The controller 70 can also receive input from various additional sensors 78, which are known in the art and not shown for simplicity. Non-limiting examples of additional sensors 78 that can be communicably coupled with the controller 70 include: a weight sensor, and a motor torque sensor.

Figure 3:
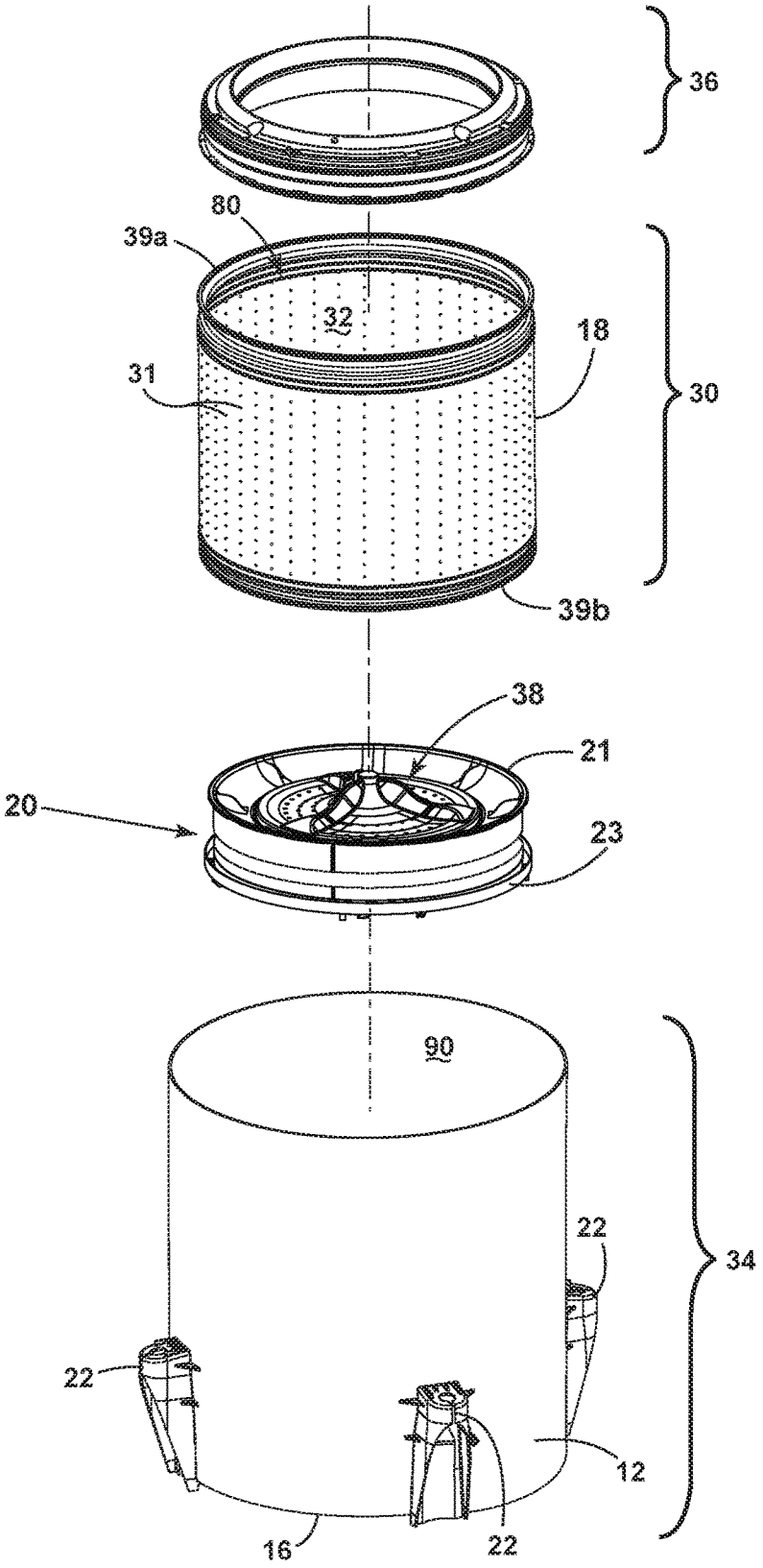
FIG. 3 is an exploded view of the two-part basket base and a complementary tub that can be included in the laundry treating appliance of FIG. 1 in accordance with the present disclosure.

Turning to FIG. 3, the components comprising the basket 30 and surrounding elements of FIG. 1 are more easily seen. For example, it can more easily be seen that the basket base 20 comprises an upper base portion 21 and a separate lower base portion 23 that can be operably coupled together to form the basket base 20. The basket 30 has a side wall 18, with the side wall 18 having perforations 31 and being sized to be received within the tub 34 (FIG. 1). The side wall 18 of the basket 30 can also be provided with embosses. The side wall 18 has an upper or terminal edge 39*a* and a lower edge 39*b*. The side wall 18 is retained between the balancing ring 36 and the basket base 20, which can collectively be thought of as a basket assembly, with the side wall 18 defining an interior that forms the treating chamber 32 and the side wall terminal edge 39*a* defining the access opening 80. The side wall 18 can be rigid. The side wall 18 is cylindrically shaped, while other shapes are contemplated, and can be made of any suitable material such as, but not limited to, metal, plastic, or composite.

The side wall 18 terminates at the balance ring 36 opposite of the basket base 20. At the top of the basket 30, the side wall 18 can mount to the balance ring 36 at the basket terminal edge 39*a*. At the bottom of the basket 30, the side wall 18 mounts to the basket base 20 at the lower edge 39*b*. The basket 30 mounts within the tub interior 90 (FIG. 1), such that the volume of the basket 30 and the basket base 20 resides within the tub 34 with the tub peripheral wall 12 disposed around the side wall 18.

Figure 4:
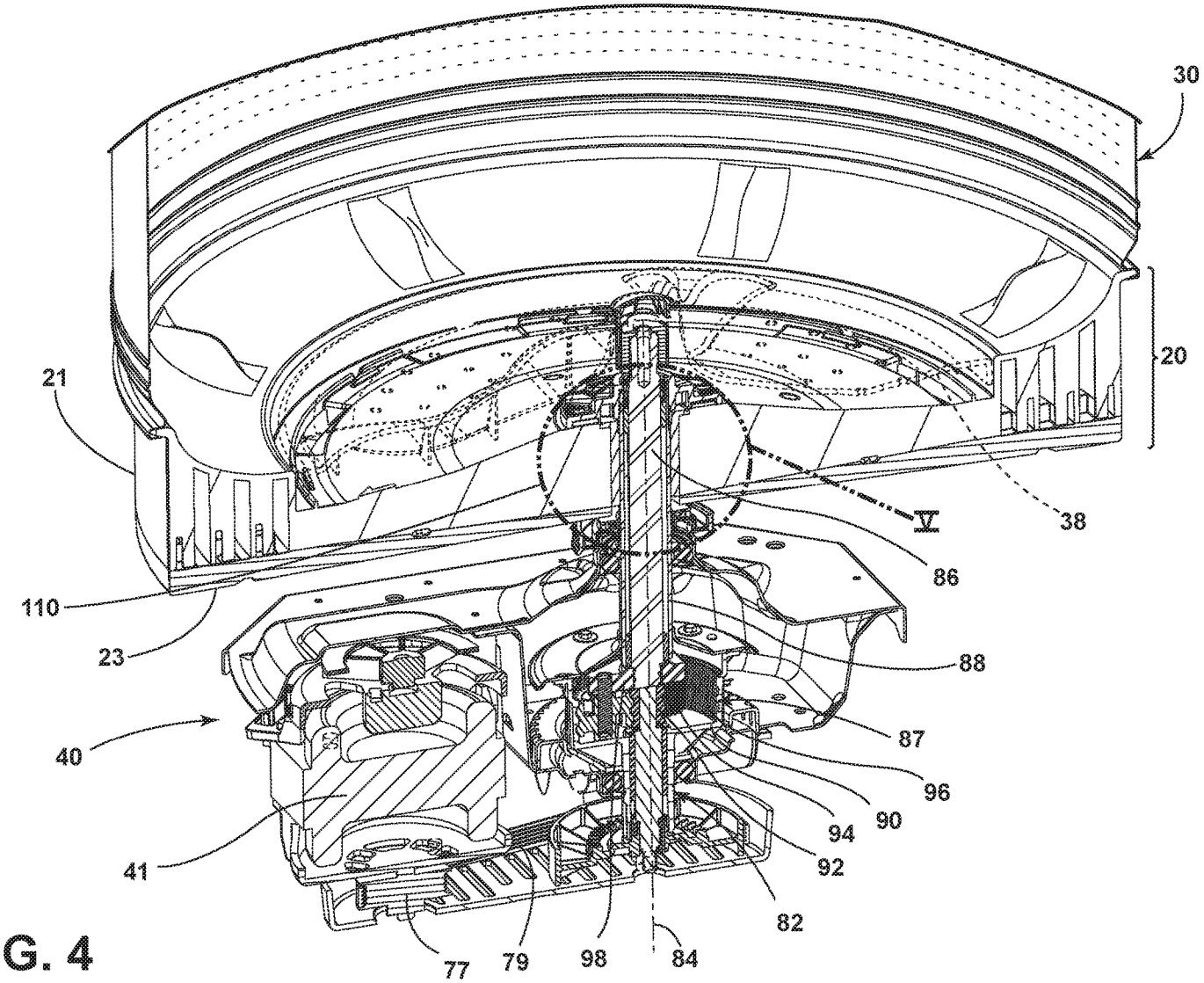
FIG. 4 illustrates a perspective view of a portion of a basket, impeller, drive system, and drive attachment mechanism that can be included in the laundry treating appliance of FIG. 1 in accordance with the present disclosure.

The basket 30, clothes mover 38, and drive system 40 are shown in greater detail in FIG. 4. The motor 41 can be drivingly coupled to the clothes mover 38 to selectively oscillate or rotate the clothes mover 38. More specifically, the motor 41 can include an output 77 that is connected through a belt system 79 to an output drive shaft 82 configured to rotate about an axis of rotation 84. Alternatively, the motor 41 could be directly connected to the output drive shaft 82. The output drive shaft 82 can further include a first drive shaft 86 configured to couple with and rotate the clothes mover 38 and a second drive shaft 88 configured to couple with and rotate the basket 30. As shown, the first drive shaft 86 can be concentric to, and positioned within the interior diameter of the second drive shaft 88. Each drive shaft 86, 88 can be configured to rotate, for example, independently of the other, in unison with the other, or at dissimilar rotational speeds or directions from the other. A drive attachment mechanism 110 is provided about the second drive shaft 88 and is configured to couple the basket 30, specifically the basket base 20, to the second drive shaft 88.

The drive system 40 can further include a planetary drive mechanism having a planetary gearbox 87. The planetary gearbox 87 can include a gearbox housing 90, a sun gear 92, a set of planet gears 94, and an outer concentric ring gear 96, wherein the gears 92, 94, 96 are positioned within the housing 90. The sun gear 92 is rotationally coupled with the drive shaft 82, and includes gears configured to mesh with and rotate the set of planet gears 94 positioned concentrically about the sun gear 92 and within the outer ring gear 96. Each of the planet gears 94 is coupled with a planet carrier 98 such that the rotation of the planet gears 94 about the ring gear 96, as driven by the sun gear 92, rotates the planet carrier 98 about the axis of rotation 84. The planet carrier 98 can be further coupled with the first drive shaft 86 to rotate the clothes mover 38. The ring gear 96 is operably connected with the basket 30 via the second drive shaft 88, which can also be known as a spin tube.

The planetary gearbox 87 can be configured in any suitable manner including that it can be configured in a speed-reducing configuration, such that the output rotational speed of the first drive shaft 86 is less than the rotational speed of the drive shaft 82. The planetary gearbox 87, sun gear 92, planet gears 94, ring gear 96, and the like, can be configured or selected to provide a desired rotational speed-reducing ratio based on the rotational speed of the drive shaft 82, the desired rotational speed of the clothes mover 38, or the desired agitation of the washing machine 10 or the cycle of operation. Alternatively, embodiments of the disclosure are envisioned wherein the motor 41 does not include a gearbox, and the drive shaft 82 is directly coupled with at least one of the first or second drive shafts 86, 88.

Figure 5:
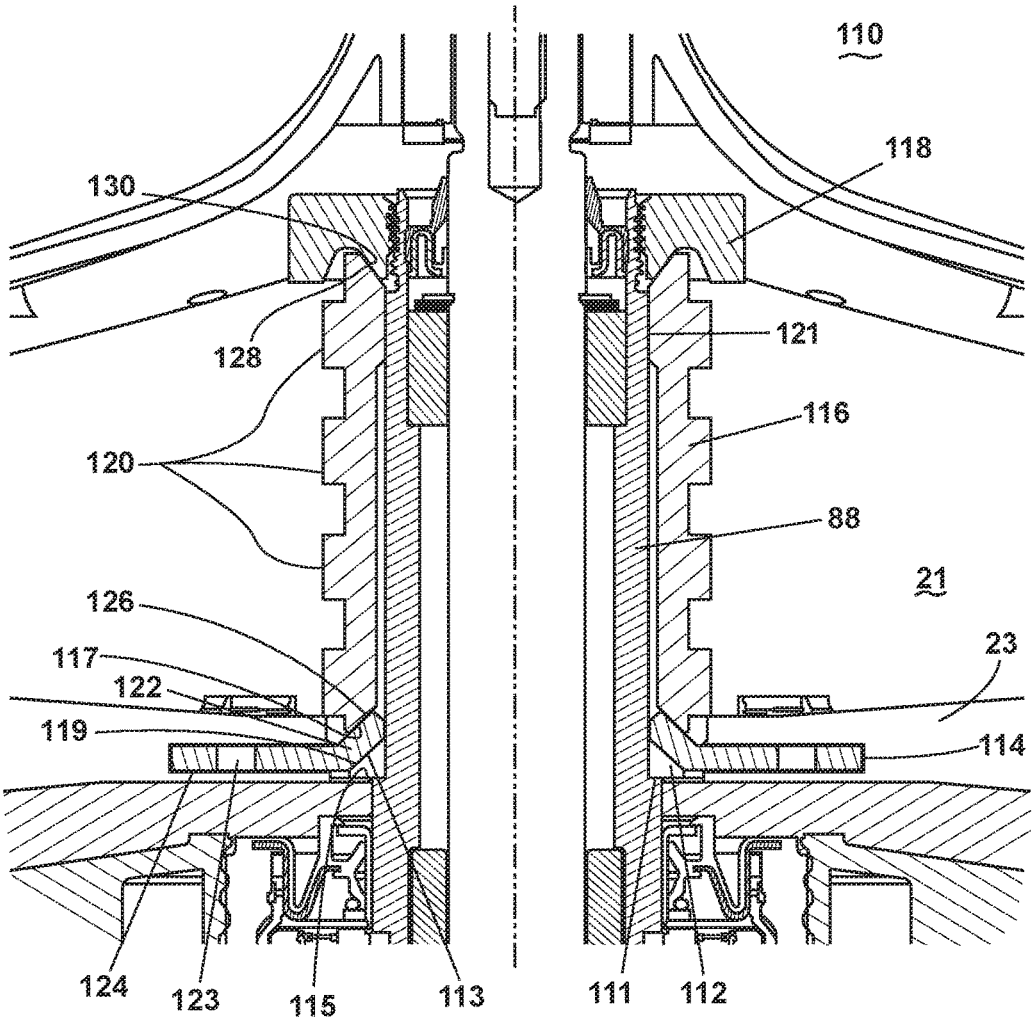
FIG. 5 illustrates an enlarged view of the drive attachment mechanism shown in FIG. 4.

Turning now to FIG. 5, the drive attachment mechanism 110 is shown in enlarged detail. The drive attachment mechanism 110 comprises a thrust washer 112, lower bushing insert 114, upper bushing insert 116, and lock nut 118. The thrust washer 112 has a ring shape and is provided circumferentially about the second drive shaft 88 and rests upon a ledge 111 provided in the outer surface of the second drive shaft 88. The ledge 111 on the outer surface of the second drive shaft 88 is positioned at generally the same height as the lowermost edge of the lower base portion 23 of the basket base 20. The thrust washer 112 has an upper surface 113 that is angled relative to a lower surface 115 of the thrust washer 112 in an exemplary embodiment. The upper surface 113 has been illustrated as being provided at a 45 degree angle relative to the lower surface 115 but it will be understood that while the thrust washer 112 can have an upper surface 113 with any suitable angle including that the angle could be greater or less than 45 degrees. The angled upper surface 113 aids in mitigating friction forces and also in creating a pivot point, which can function like a ball joint, between the thrust washer 112 and the basket 30. The angled upper surface 113 of the thrust washer 112 translates the clamp load from the lock nut 118, the lower bushing insert 114, and the upper bushing insert 116 inward towards the second drive shaft 88. This allows overturning moments during operation to translate into the lower bushing insert 114 and the lower base portion 23. This pivot point created by the angled upper surface 113 of the thrust washer 112 and the lower bushing insert 114, coupled with the upper pivot point created between the upper bushing insert 116 and the lock nut 118 provide a kinematically locked assembly.

The thrust washer 112 further can have a split (not shown) in its circumference such that the thrust washer 112 is not continuous along the full 360 degree ring. More specifically, when the thrust washer 112 is in an uninstalled condition, there can be a visible gap at the split in the thrust washer 112. When the thrust washer 112 is press fit to be installed around the second drive shaft 88, the thrust washer 112 is compressed about the second drive shaft 88 for a zero clearance fit. The split in the thrust washer 112 can be expanded, which allows for a zero-clearance press fit around the second drive shaft 88 when the thrust washer 112 is installed. When the basket base 20 is in the fully assembled condition, a clamp force is generated between the thrust washer 112 and the second drive shaft 88, even though the split or gap remains. The thrust washer 112 can be formed of stainless steel, or any other suitable material, non-limiting examples of which include other metals or plastics which have sufficient strength and are robust to exposure to wash liquid and chemistries.

The lower bushing insert 114 has a generally ring-like shape and is provided circumferentially about the second drive shaft 88. A radial inner portion 122 of the lower bushing insert 114, at a point at which the lower bushing insert 114 is positioned most closely about the second drive shaft 88, can be formed such that the radial inner portion 122 angles upwardly and forms an angled lower surface 119 and an angled upper surface 117. The angled upper surface 117 of the lower bushing insert 114 is shaped to fit tightly with the upper bushing insert 116. The angled upper surface 117 can be formed through any suitable process, non-limiting examples of which include casting, machining, etc. The angled lower surface 119 of the radial inner portion 122 can be angled or chamfered in a manner that is complementary to and is positioned on top of and supported by the angled surface 113 of the thrust washer 112. The angled lower surface 119 of the radial inner portion 122 can be machined to achieve the desired angled after the basket base 20 has been fully assembled. This corrects for the total indicated run-out that can be introduced during assembly of the basket base 20.

The lower bushing insert 114 is a casted piece with a flange 124 extending radially outward from the radial inner portion 122. The lower bushing insert 114 is mounted within the lower base portion 23. The mounting of the lower bushing insert 114 within the lower base portion 23 can be done by insert molding or via any other suitable attachment method. A set of openings 123 can be provided in the flange 124 of the lower bushing insert 114 to accommodate additional fasteners for mounting the lower bushing insert 114 to the lower base portion 23. It will be understood that the openings 123 can also be filled with the plastic of the lower base portion 23 during an insert molding or over molding process in order to create a mechanical lock between the lower base portion 23 and the flange 124 of the lower bushing insert 114. A 'set' as used herein can include any number including only one.

The upper bushing insert 116 is a piece that is insert molded into the upper base portion 21. The upper bushing insert 116 is generally cylindrical in form and can be provided circumferentially about the second drive shaft 88. When the lower base portion 23 and the upper base portion 21 are mounted together the upper bushing insert 116 is positioned on top of and is supported by the radial inner portion 122 of the lower bushing insert 114. The upper bushing insert 116 can be formed by any suitable method, non-limiting examples of which include an extrusion process, casting, or machining in order to form the final product.

More specifically, a lower surface 126 is included in the upper bushing insert 116 that has an angle complementary to that of the upper surface 117 of the radial inner portion 122 of the lower bushing insert 114 such that the radial inner portion 122 of the lower bushing insert 114 interfaces with the lower surface 126 of the upper bushing insert 116. The lower surface 126 of the upper bushing insert 116 can be formed through any suitable process, non-limiting examples of which include machining, casting, etc. The upper end 128 of the upper bushing insert 116 has an angled or chamfered surface complimentary to the lock nut 118.

The upper bushing insert 116 is further provided with a set of tabs 120 provided on the outer surface of the upper bushing insert 116 and that extend radially outward. The set of tabs 120 facilitate the molding of the upper bushing insert 116 into the upper base portion 21 of the basket base 20, improving the robustness and strength of the attachment. The set of tabs 120 can be any suitable shape including, but not limited to, that they may be T-shaped. In the case that the set of tabs 120 are T-shaped, the projecting portion of the T-shape would extend either forward or backward from the plane of the cross-section illustrated in FIG. 5. The upper bushing insert 116 is also provided with splines along the inner diameter 121 of the upper bushing insert 116 where it engages with the second drive shaft 88. The lower bushing insert 114 and the upper bushing insert 116 can be collectively thought of as a bushing assembly.

The lock nut 118 is threadably mounted to the second drive shaft 88 and is further operably coupled to an upper end 128 of the upper bushing insert 116. The lower surface of the lock nut 118 has a sphericalprofile such that the spherical surface 130 is shaped convexly outward relative to and engages with the angled surface of the upper end 128 of the upper bushing insert 116. In this way, the lock nut 118 operably couples the upper end 128 of the upper bushing insert 116 to the second drive shaft 88 in a ball-joint-like design. The design of the interface between the upper bushing insert 116 and the lock nut 118 provides center points for the drive attachment mechanism 110 that extend beyond the attachment to the upper base portion 21 of the basket base 20. These center points increase the stiffness of the drive attachment mechanism 110 and increase resistance to overturning operations, in addition to kinematically locking the drive attachment mechanism 110.

The motor 41 operates as controlled by the controller 70. The rotational speed of the drive shaft 82 can be reduced by the planetary gearbox 87 and delivered to the clothes mover 38 to rotate the clothes mover 38, which ultimately provides movement to the laundry load contained within the laundry treating chamber 32. When the washer is operating in the agitate mode, the motor 41 is operated in a reversing fashion which causes the drive shaft 82 to oscillate, thus driving the sun gear 92 in alternating opposite directions. The clothes mover 38 is therefore oscillated through its connection with the planet gears 94. The wash basket 30 can be held stationary while the clothes mover 38 is oscillated, for example by means of a brake mechanism (not shown).

When the motor 41 operates, causing rotation of the ring gear 96, the second draft shaft 88 is rotated correspondingly. Primary transfer of torque between the second drive shaft 88 and the drive attachment mechanism 110 occurs via the splines (not shown) located on the inner diameter 121 of the upper bushing insert 116. The thrust washer 112, which is press fit circumferentially about the second draft shaft 88 with zero clearance, is operably coupled with the second drive shaft 88 and can also provide some frictional component of torque between thrust washer 112 and the second drive shaft 88. Operable coupling at the interfaces between the upper bushing insert 116 and the lock nut 118, between the upper bushing insert 116 and the lower bushing insert 114, and between the lower bushing insert 114 and the thrust washer 112 allows all of the components of the drive attachment mechanism 110 to rotate the basket base 20 and the basket 30 as driven by the motor 41. The multiple interfaces between the components of the drive attachment mechanism 110, in particular the joint-like interfaces between the thrust washer 112 and the lower bushing insert 114 and between the upper bushing insert 116 and the lock nut 118, serve to push the overturning moment deeper into the basket base 20 and give robustness to the assembly. Having the center points of the two joint-like interfaces spaced apart from one another lends robustness to the assembly to prevent the overturning moment from bending the second drive shaft 88 relative to the basket 30.

Figure 6:
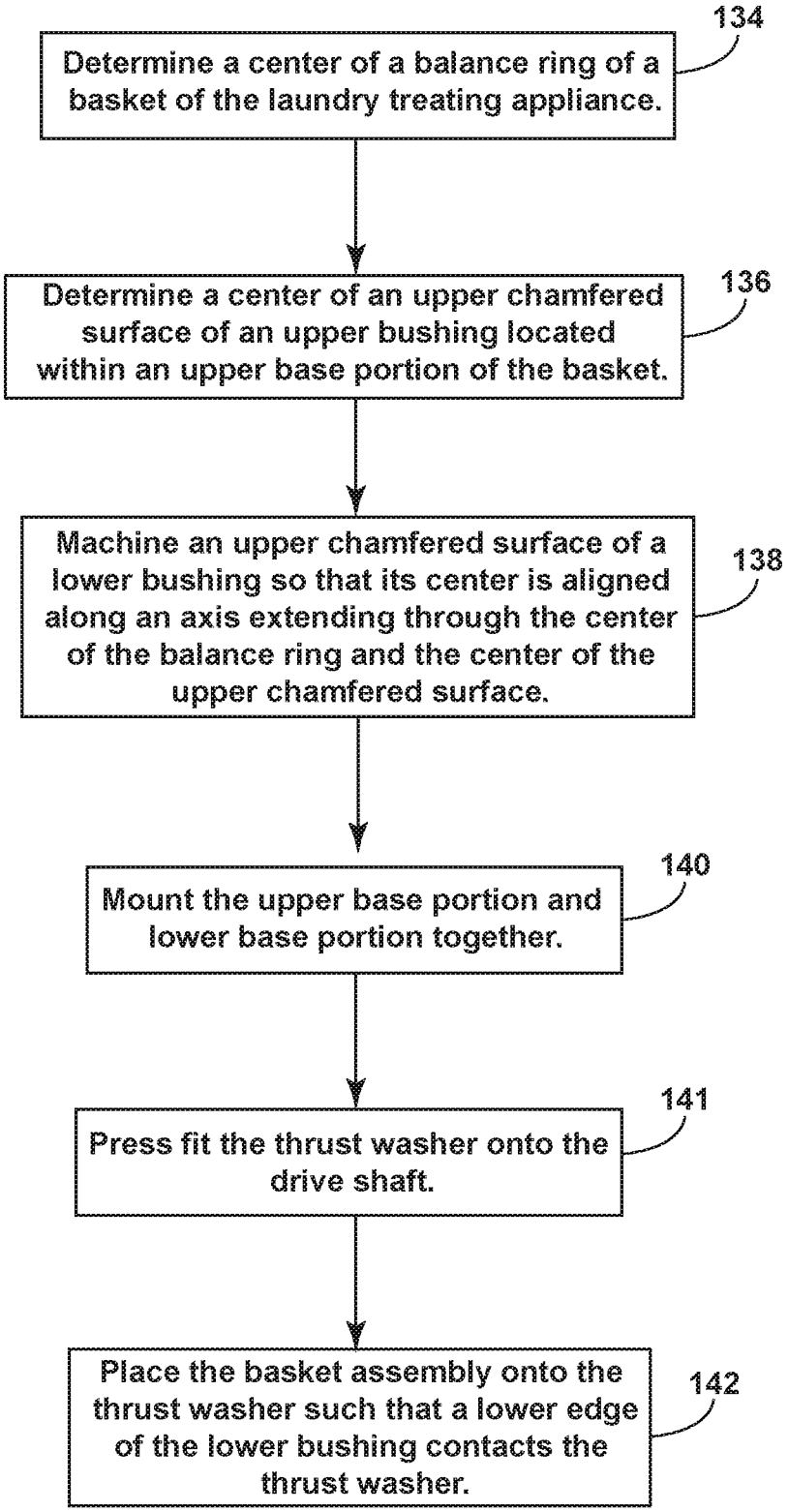
FIG. 6 illustrates a flow chart detailing a method of assembly and installation of a drive attachment mechanism according to the invention.

FIG. 6 illustrates one embodiment of a method of installing the drive attachment mechanism 110 of FIG. 5 in the washing machine 10 of FIG. 1. At 134, the center of the balance ring 36 of the basket 30 is determined. At 136, the center of the chamfered upper surface 128 of the upper bushing insert 116 is determined. The upper bushing insert 116 is already mounted or insert molded within the upper base portion 21 prior to step 136, as described previously. At 138, the chamfered lower angled surface 119 of the radial inner portion 122 of the lower bushing insert 114 is machined so that its center is aligned along an axis extending through the center of the balance ring 36 and the center of the chamfered upper surface 128 of the upper bushing insert 116 such that the center of the lower angled surface 119 of the radial inner portion 122 of the lower bushing insert 114 is aligned with the spin center of the balance ring 36 to correct for total indicated run-out. As described previously, the lower bushing insert 114 has a flange 124 that is mounted or insert molded into the lower base portion 23 prior to step 138. At 140, the upper base portion 21 containing the upper bushing insert 116 and the lower base portion 23 containing the lower bushing insert 114 are mounted together. While it is contemplated that the upper base portion 21 and lower base portion 23 can be mounted together by plastic welding, it will be understood that any other suitable method of mounting the upper and lower base portions 21, 23 together can be used. At 141, the thrust washer 112 is press fit onto the second drive shaft 88 of the washing machine 10. At 142, the basket assembly completed at 140 is placed onto the thrust washer 112 such that the lower angled surface 119 of the lower bushing insert 114 contacts the thrust washer 112.

In a traditional vertical axis laundry treating appliance, the drive attachment mechanism for attaching the drive to the basket and the clothes mover can be a significant contributor to cost, complexity, and overall weight of the laundry treating appliance. For example, incorporating a drive attachment mechanism robust enough to withstand the overturning forces placed on the drive area can require the use of a large and/or complex basket base. Such basket base structures are traditionally formed of some sort of metal, adding significant weight to the basket assembly of the washing machines. The various aspects described herein remove the need for a large, heavy basket base, while still providing the robustness required for the demands of the washing machine. Aspects of the present disclosure provide similar performance to contemporary appliances while reducing the total indicated runout of the system. Features of the present disclosure also improve the torque transfer and robustness of the assembly.

To the extent not already described, the different features and structures of the various embodiments can be used in combination with each other as desired. That one feature may not be illustrated in all of the embodiments is not meant to be construed that it cannot be, but is done for brevity of description. Thus, the various features of the different embodiments can be mixed and matched as desired to form new embodiments, whether or not the new embodiments are expressly described. All combinations or permutations of features described herein are covered by this disclosure.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A laundry treating appliance for treating laundry according to an automatic cycle of operation, comprising:

a tub defining a tub interior;

a basket rotatably mounted within the tub interior and having a basket base comprising an upper base portion and a separate lower base portion mounted to the upper base portion and a basket peripheral wall extending from the basket base, with the basket base and the basket peripheral wall defining a basket interior forming at least part of a laundry treating chamber, the basket peripheral wall terminating at an upper edge; and a balance ring mounted to the upper edge of the basket peripheral wall;

a clothes mover rotatably mounted within the basket interior;

a drive system, comprising:

a motor operably coupled to the basket and the clothes mover and configured to selectively oscillate or rotate the basket or the clothes mover;

a first drive shaft operably coupled to the motor and the clothes mover to oscillate or rotate the clothes mover; and a second drive shaft operably coupled to the motor and the basket to oscillate or rotate the basket; and a drive attachment mechanism configured to couple the basket to the second drive shaft and comprising a bushing assembly having an upper bushing insert molded into the upper base portion and a lower bushing insert molded into the lower base portion and a lock nut operably coupled to an upper end of the bushing assembly and threadably mounted to the second drive shaft.

2. The laundry treating appliance of claim 1 wherein the drive attachment mechanism further comprises a thrust washer press fit onto a portion of the second drive shaft and configured to support a portion of the lower bushing.

3. The laundry treating appliance of claim 1 wherein the upper bushing comprises an extruded piece with a machined lower surface.

4. The laundry treating appliance of claim 3 wherein the extruded piece comprises at least one tab molded into the upper base portion.

5. The laundry treating appliance of claim 4 wherein the extruded piece comprises multiple T-shaped tabs insert molded into the upper base portion.

6. The laundry treating appliance of claim 3 wherein the lower bushing comprises a flange portion configured to be mounted within the lower base portion and an upper surface configured to interface with the machined lower surface of the upper bushing.

7. The laundry treating appliance of claim 6 wherein the lower surface of the upper bushing and the upper surface of the lower bushing comprise 45 degree angle surfaces that form the interface.

8. The laundry treating appliance of claim 1 wherein the first drive shaft and the second drive shaft are configured to rotate independently of the other, in unison with the other, or at dissimilar rotational speeds or directions from the other.

9. The laundry treating appliance of claim 1 wherein the lower surface of the upper bushing and the upper surface of the lower bushing form an interface.

10. A laundry treating appliance for treating laundry according to an automatic cycle of operation, comprising:

a tub defining a tub interior;

a basket rotatably mounted within the tub interior and having a basket base comprising an upper base portion and a separate lower base portion mounted to the upper base portion and a basket peripheral wall extending from the basket base, with the basket base and the basket peripheral wall defining a basket interior forming at least part of a laundry treating chamber, the basket peripheral wall terminating at an upper edge; and a motor operably coupled to the basket via a drive shaft and a drive attachment mechanism and where the motor is configured to selectively oscillate or rotate the basket within the tub; and wherein the drive attachment mechanism is configured to couple the basket to the drive shaft and comprises a bushing assembly having an upper bushing insert molded into the upper base portion, a lower bushing insert molded into the lower base portion, a lock nut operably coupling an upper end of the upper bushing to the drive shaft, and a thrust washer press fit onto a portion of the drive shaft and configured to support a portion of the lower bushing and wherein the upper bushing and lower bushing are operably coupled at an interface at a lower edge of the upper bushing and an upper edge of the lower bushing.

11. The laundry treating appliance of claim 10 wherein the lower edge of the upper bushing and the upper edge of the lower bushing comprise 45 degree angle surfaces that form the interface.

12. The laundry treating appliance of claim 10 wherein the lower bushing comprises a flange portion extending into the lower base portion and a lower angled surface that contacts the thrust washer.

13. The laundry treating appliance of claim 10 wherein the upper bushing comprises a set of tabs insert molded into the upper base portion.

14. The laundry treating appliance of claim 10 wherein the lower bushing comprises a casted piece having a machined upper edge that is complementary to the lower edge of the upper bushing.

15. A laundry treating appliance for treating laundry according to an automatic cycle of operation, comprising:

a tub defining a tub interior;

a basket rotatably mounted within the tub interior and having a basket base comprising an upper base portion and a separate lower base portion mounted to the upper base portion and a basket peripheral wall extending from the basket base, with the basket base and the basket peripheral wall defining a basket interior forming at least part of a laundry treating chamber, the basket peripheral wall terminating at an upper edge; and a motor operably coupled to the basket via a drive shaft and a drive attachment mechanism and where the motor is configured to selectively oscillate or rotate the basket within the tub; and wherein the drive attachment mechanism is configured to couple the basket to the drive shaft and comprises a bushing assembly having an upper bushing insert molded into the upper base portion, a lower bushing insert molded into the lower base portion and where an upper edge of the lower bushing is operably coupled at an interface to a lower edge of the upper bushing, a lock nut operably coupling an upper end of the bushing assembly to the drive shaft, and a thrust washer press fit onto a portion of the drive shaft and configured to support a portion of the lower bushing.

16. The laundry treating appliance of claim 15 wherein the lower edge of the upper bushing and the upper edge of the lower bushing comprise 45 degree angle surfaces that form the interface.

17. The laundry treating appliance of claim 15 wherein the lower bushing comprises a flange portion extending into the lower base portion and a lower angled surface that contacts the thrust washer.

18. The laundry treating appliance of claim 15 wherein the upper bushing comprises a set of tabs insert molded into the upper base portion.

19. The laundry treating appliance of claim 15 wherein the lower bushing comprises a casted piece having a machined upper edge that is complementary to the lower edge of the upper bushing.

* * * * *